US005924941A

United States Patent [19]

Hagey

[11] Patent Number: 5,924,941

[45] Date of Patent: Jul. 20, 1999

[54] HAND GRIP FOR A RACQUET

[76] Inventor: Edward H. Hagey, 3653 Jennifer St., San Diego, Calif. 92117

[21] Appl. No.: 08/793,351

[22] PCT Filed: Dec. 26, 1995

[86] PCT No.: PCT/US95/16234

§ 371 Date: Feb. 24, 1997

§ 102(e) Date: Feb. 24, 1997

[87] PCT Pub. No.: WO96/20029

PCT Pub. Date: Jul. 4, 1996

Related U.S. Application Data

[63] Continuation-in-part of application No. 08/363,606, Dec. 23, 1994, Pat. No. 5,492,324, and application No. 08/459,302, Jun. 2, 1995, Pat. No. 5,671,926.

[51] Int. Cl.[6] ..... A63B 49/08

[52] U.S. Cl. ..... 473/551; 473/549

[58] Field of Search ..... 473/549, 551, 473/FOR 173, 183, 300, 568

[56] References Cited

U.S. PATENT DOCUMENTS

| | | | |
|---|---|---|---|
| 412,479 | 10/1889 | Davis . | |
| 2,031,161 | 2/1936 | Hamel . | |
| 2,302,191 | 11/1942 | Covington . | |
| 3,868,110 | 2/1975 | Jones | 473/551 |
| 4,065,127 | 12/1977 | Fagan . | |
| 4,067,573 | 1/1978 | Key, Jr. . | |
| 4,072,311 | 2/1978 | Bertucci | 473/551 |
| 4,213,609 | 7/1980 | Swanson . | |
| 4,355,803 | 10/1982 | Rama . | |
| 4,402,508 | 9/1983 | Pflueger | 473/551 |
| 4,438,925 | 3/1984 | Lindstrom . | |
| 4,545,584 | 10/1985 | Adam . | |
| 4,641,838 | 2/1987 | Gabrielidis . | |
| 4,664,381 | 5/1987 | Aaron | 473/551 |
| 4,736,950 | 4/1988 | Doyle . | |
| 4,828,261 | 5/1989 | Kleylein . | |
| 4,848,746 | 7/1989 | Klink . | |
| 4,968,032 | 11/1990 | Redekop . | |
| 5,018,734 | 5/1991 | Allsop . | |
| 5,042,804 | 8/1991 | Uke et al. . | |
| 5,064,203 | 11/1991 | Hattori | 473/551 |
| 5,269,516 | 12/1993 | Janes . | |
| 5,295,684 | 3/1994 | Bracho . | |
| 5,316,316 | 5/1994 | Lai . | |
| 5,322,278 | 6/1994 | Jeanrot . | |
| 5,398,930 | 3/1995 | Gibson . | |
| 5,460,372 | 10/1995 | Cook . | |
| 5,482,270 | 1/1996 | Smith | 473/551 X |
| 5,492,324 | 2/1996 | Hagey . | |
| 5,556,092 | 9/1996 | Theken | 473/551 X |
| 5,657,985 | 8/1997 | Dahlstrom et al. | 473/551 X |
| 5,671,926 | 9/1997 | Hagey | 473/549 |

FOREIGN PATENT DOCUMENTS

| | | |
|---|---|---|
| 519312A1 | 12/1992 | European Pat. Off. . |
| 2232337 | 2/1975 | France . |
| 3628618 | 11/1987 | Germany . |
| 3726753 | 2/1989 | Germany . |
| 3733425 | 2/1989 | Germany . |
| 3842126 | 8/1990 | Germany . |
| 4019039 | 12/1991 | Germany . |
| 157421 | 5/1991 | Taiwan . |
| 210025 | 7/1993 | Taiwan . |
| 220169 | 2/1994 | Taiwan . |
| 230376 | 9/1994 | Taiwan . |
| 662110 | 5/1979 | U.S.S.R. . |
| 20882 | 11/1908 | United Kingdom . |
| 2133294 | 7/1984 | United Kingdom . |
| WO8902297 | 3/1989 | WIPO . |

*Primary Examiner*—Raleigh W. Chiu
*Attorney, Agent, or Firm*—Walter W. Duft

[57] ABSTRACT

This invention is a racquet handle configuration for a tennis racquet handle having a knob (50) to engage the forefinger, a protrusion (40) to engage the saddle formed between the forefinger and thumb of the user when using an Eastern forehand grip, and an extended rear surface to receive the thumb fully when assuming the Eastern backhand grip.

7 Claims, 6 Drawing Sheets

3rd knuckle
2nd knuckle
1st knuckle
FORE
MIDDLE
FOURTH
LITTLE
foot of thumb
inner arch of thumb
Saddle
Forefinger base
butt of hand Foot of thumb
Thumb joint
Inner arch of thumb 16
28
24

22
16
20
28
18
30

18
26

10
44
42
40
13
35°
90°
46
50
43
30
18
28

40
30
18
28
50

50
24
13
16
28
13
40
48
47

HAND GRIP FOR A RACQUET

The present application is a continuation in part of my applications 08/363,606 filed Dec. 23, 1994 entitled "Tennis Racket With Enhanced Handle Kit" now U.S. Pat. No. 5,492,324 and my relating application Ser. No. 08/459,302 filed Jun. 2, 1995, entitled "Tennis Racket With Enhanced Hand Grip"; now U.S. Pat. No. 5,671,926; both of which are hereby incorporated by reference.

BACKGROUND OF THE INVENTION

The present invention is directed to improvements in racquets for use in several sports but is particularly directed toward an improved gripping area for a tennis racquet handle.

Of all the racquet sports, tennis is unique in its ball speed (pace) and the great deal of court coverage required by the players. Players must hit many balls on the run or after traveling great distances. For expert play, it is essential that during these maneuvers, the player have a superb sense or awareness of the location and attitude (angular disposition) of the racquet head with respect to the player's hand. Sometimes the ball must be struck when it has little or no speed. At other times, the racquet will encounter high impact forces because of the pace with which the opponent has struck the ball. Additionally, the player must return tennis balls with various spins. The player is oftentimes required to change grips while on the run. Racquet preparation is essential to expert play. Players must change their grips while running and under other difficult circumstances.

There have been many improvements in tennis racquets in the past several decades. Prior to 1970, almost all racquets were made of laminated wood. This limited the size of racquet heads and consequentially almost all tennis racquets had the same dimensions. With the advent of steel, aluminum, fiberglass, and graphite racquets, size limitations have been substantially eliminated and racquet heads have become larger.

With larger racquet heads, off-center contact with the ball creates greater torque. When a fast moving tennis ball is struck any place but in the so-called "sweet spot", a great deal of torque is imparted to the racquet which must be resisted by the hand of the racquet user. This makes racquet head awareness of even greater importance. Racquet head awareness is that sense of knowing the angular relationship and distance of the stringed head to the hand. Topographical features on the handle that are felt and recognized by the player's hand are believed to enhance awareness. Although conventional octagonal handle designs impart some awareness, the instant invention described herein increases awareness dramatically.

For almost a century, tennis racquet handles have been octagonal in cross-section. After about 1930, it became common to wrap the octagonal handle with a leather strip for comfort and friction. This racquet handle design is almost universally used in tennis racquets at the present time.

In order to appreciate the full measure of this invention, it should be understood that the vast majority of players use two different grips when stroking the ball. One grip is used for the forehand and the other grip is used for the backhand. Players typically use the backhand grip, or a grip between the forehand and backhand grip, for the serve.

The most common forehand grip (known as the Eastern forehand), and that preferred by many tennis instructors, places the first knuckle of the index finger squarely behind one of the planner surfaces of the octagonal handle, the palm in engagement with that planner surface parallel to the plane of the racquet head, and the butt of the hand against a retention ridge. The fingers are angularly disposed with respect to the handle axis.

In the backhand grip (known as the Eastern backhand), the hand is rotated until the finger segments between the first and second knuckles of the third, fourth and fifth fingers are in a plane parallel to the racquet head. The thumb is typically placed diagonally across the opposite planner surface. This specification will use this grip terminology for purposes of explanation.

Some players do not like the "feel" of these commonly used grips and will rotate the hand to one side or the other. This can reduce power and, in many instances, reduce racquet head awareness. In other instances, an improper grip is assumed because of a lack of skill or because of the difficult circumstances encountered during a grip change.

Another aspect of tennis play that should be understood in order to appreciate the significance of this invention, is tennis ball spin. Top spin is obtained by moving the racquet head from a low position to a high position as the racquet is moving forward to strike the ball. Underspin is obtained by moving the racquet head from high to low while it is moving forward. Racquet head awareness is very important to the execution of these strokes.

As in golf, tennis players are constantly seeking to "groove" their stroke. In order to groove one's stroke, it has been found that a locked wrist is preferable. Most professionals strive to prevent a "floppy" wrist. While covering the court, the player will be regularly changing his grip and this will oftentimes be accomplished while he or she is "on the run." The configuration of the present handle aids the player by causing the hand to quickly and surely assume and recognize the desired grip so that the swing can be grooved by reducing the uncertainties and variations that are caused by irregular positioning of the hand on the handle.

The racquet of this invention is not designed for two-handed players. It is for one-handed players and, in fact, a racquet of the invention is configured for a right-handed or a left-handed player. A racquet for a right-handed player is described herein but it should be understood that left-handed racquets are just the reverse.

SUMMARY OF THE INVENTION

With the above in mind, this invention has as its principal objective to provide a handle configuration for a tennis racquet that combines the geometry of the player's hand with preferred racquet movement so that maximum power and control is obtained by the user.

Another objective of this invention is to provide an increased planner surface or protrusion to permit the thumb to engage the racquet handle in a comfortable surface while maintaining other advantages of a backhand grip.

Yet another objective of this invention is to form a depression in the aforementioned planner surface to receive the thumb so that, as the racquet head is moved upward and forward during a backhand stroke, there will be an engagement surface that positively supports the thumb in order to control the racquet for exerting a force to propel the ball with top spin.

Yet another objective of this invention is to form a depression in the aforementioned planner surface to receive the thumb so that, as the racquet head is moved downward and forward, there will be an engagement surface that aids the thumb in controlling the racquet and exerting a force to propel the ball with backspin.

A still further objective of this invention is to provide a handle configuration that makes the player fully aware of the location of his hand along the length of the handle.

Another important objective of the invention provides a trigger or knob on the handle. This trigger increases the player's awareness of his hand location with respect to the longitudinally length of the handle and at the same time will provide the player with increased racquet control.

Another important objective of the invention is to provide an engagement surface for the index finger on a tennis racquet handle so that the player will have complete racquet handle awareness during the forehand or backhand strokes.

The hand is very sensitive to width when gripping a tennis racquet handle. A sense of width is partially, if not substantially, determined by the distance between the thumb and index finder. This invention incorporates the aforementioned advantages and objectives without increasing a feeling of bulkiness.

These and other objectives and advantages of this invention will be better understood when reading the following description in conjunction with the drawings.

DESCRIPTION OF THE PREFERRED EMBODIMENTS

Figure 3:
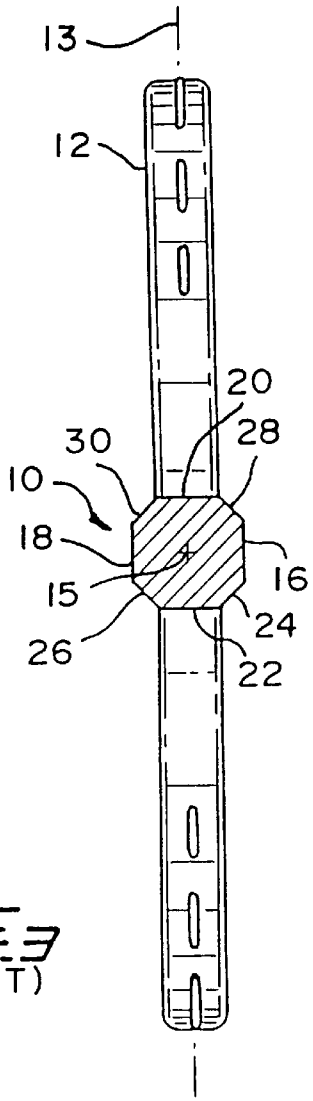
FIG. 3 (PRIOR ART)
FIG. 3 is a cross-sectional view along the line 3—3 of FIG. 2.
Figure 1:
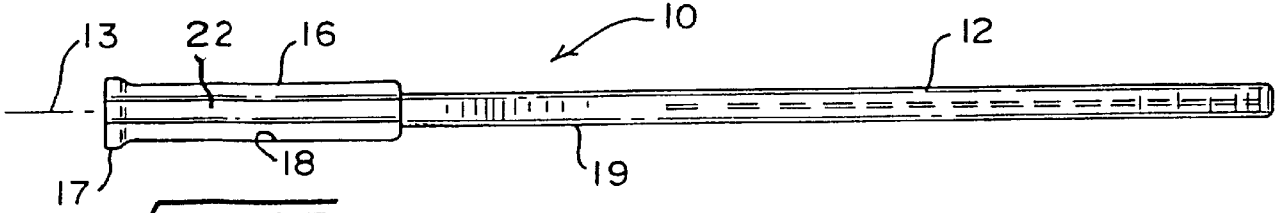
FIG. 1 (PRIOR ART)
FIG. 1 is a side elevation of a prior art tennis racquet.
Figure 2:
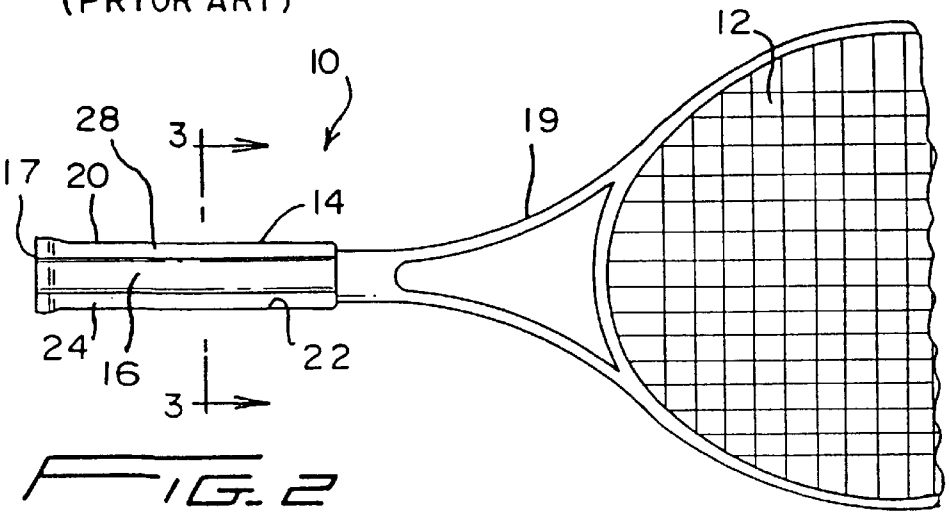
FIG. 2 (PRIOR ART)
FIG. 2 is a plan view of the tennis racquet of FIG. 1.

Referring now to the drawings wherein like numerals indicate like parts, the numeral 10 indicates a prior art racquet. The racquet includes a stringed racquet head 12, lying in a plane 13, which is supported by a handle 14. The longitudinal axis 15 of the handle 14 lies in plane 13. Almost all present day handles are octagonal in cross-section. The handle 14 and racquet 12 are joined by a throat section 19. The handle 14 is annularly ridged at its bottom or base end at 17 so that the hand will not slip from the end of the racquet. Although not shown in this description, it is to be understood that most embodiments of this invention will be wrapped with a leather strap or similar material in a manner similar to handles of the prior art.

FIG. 3 is for purposes of illustration and nomenclature. The octagonal design is comprised of a right (or front with a backhand grip) planner surface 16 and a rear left planner surface 18 parallel thereto. Surface 16 will face the net during a backhand stroke and surface 18 will be the trailing surface. The opposite is true during forehand stroke. The octagonal design includes a top planner surface 20 and a bottom planner surface 22. The top planner surface 20 is joined to right planner surface 16 by upper right planner surface 28, and to the surface 18 by upper left planner surface 30. The bottom surface 22 is joined to the surface 16 by lower right surface 24, and the bottom surface 22 is joined to surface 18 by the lower left surface 26. The surfaces 16 and 18 typically have a slightly greater width than the top surface 20 and the bottom surface 22. The surfaces, where joined, form ridges therebetween.

Figures 4, 5, 6, 7, 7A:
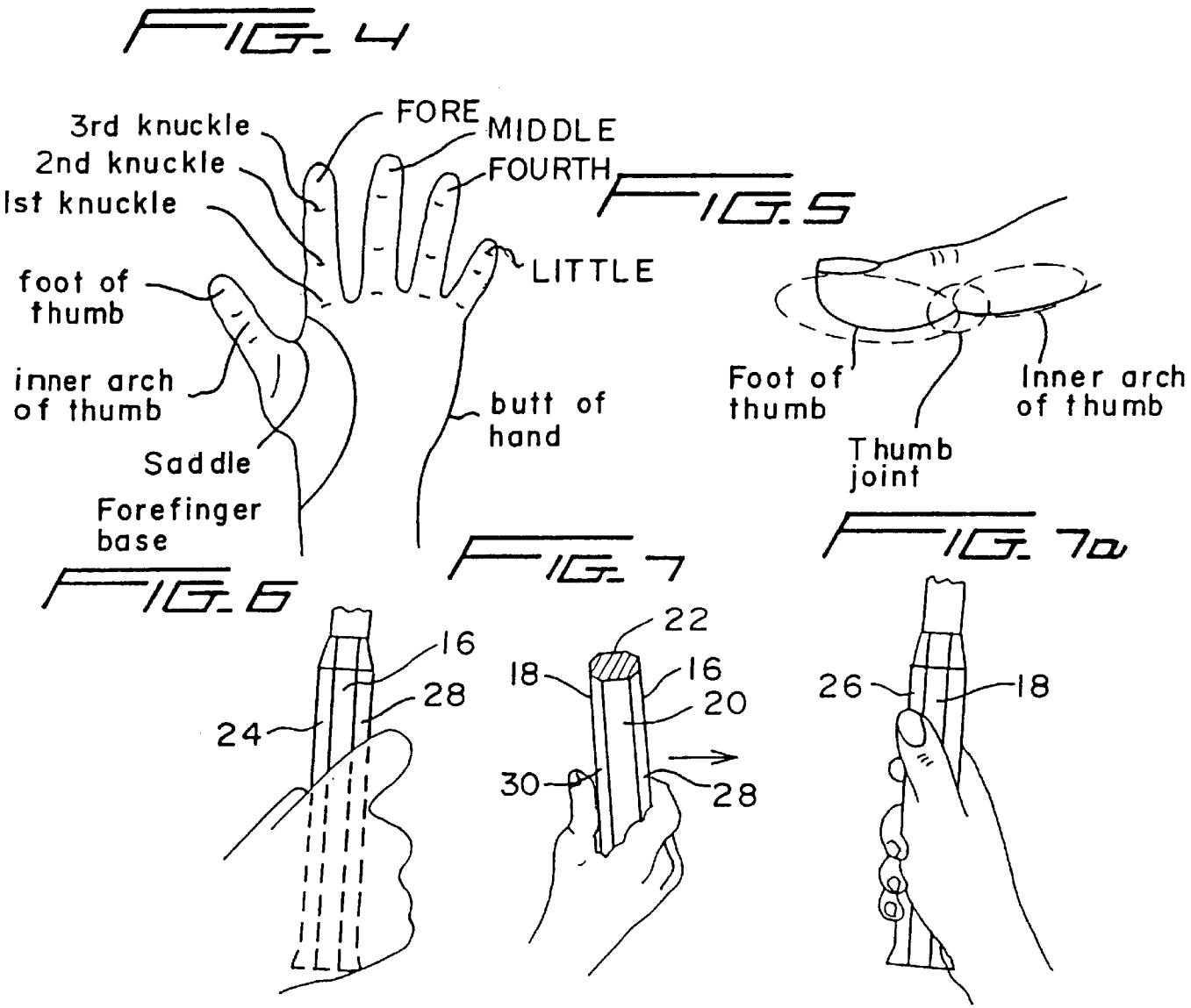
FIG. 4 is a plan view of the palm side of a player's hand.
FIG. 5 is a side view of a player's thumb.
FIG. 6 is a perspective view of a forehand grip commonly referred to as the Eastern forehand.
FIG. 7 is a perspective view of a backhand grip commonly referred to as the Eastern backhand.
FIG. 7*a* is a view with a better showing of thumb overlap of two surfaces in a prior art racquet.

FIG. 4 is a palm view of a right hand with certain elements thereof labeled for reference and nomenclature purposes.

FIG. 5 is a side elevation of a thumb for the same purpose.

The conventional Eastern forehand grip on a conventional racquet is shown on FIG. 6. The palm of the user's right hand is flush against the surface 16 with the first knuckle of the forefinger directly behind that same surface. As the racquet moves forward, away from the viewer as shown in FIG. 6, it can be seen that the full force of the player's arm and hand is behind the racquet handle with the thumb and fingers used as securement devices.

FIGS. 7 and 7*a* show the Eastern backhand grip. Note that the hand has been rotated approximately 45° so that the thumb is diagonally disposed across the surface 18. When so disposed, the thumb normally extends beyond the surface 18, and at times contacts or is over surface 26 (see FIG. 7*a*). Thus, some thumb control is lost and the grip feels abnormal to many players which will cause them to assume less desirable grips.

Top spin is obtained by moving the racquet from a low position to a high position as it strikes the ball. This upward movement is accompanied with a forward movement that propels the ball into the other player's court. In FIG. 7 it can be seen that the thumb provides a major backup support for the racquet during a backhand stroke. With the Eastern forehand and backhand grips, the racquet head is held vertical with little wrist action. Some players have a tendency to place the thumb in alignment with the rear planner surface rather than diagonally. This is undesirable and will oftentimes cause injury. However, as mentioned above, when the thumb is diagonal, the tip of the thumb oftentimes overlaps the adjacent surface 24 which feels unnatural or uncomfortable. This invention increases the dimensions of planner surface 18, to that referred to as 18*a*, so as to fully support the thumb diagonally along an axis generally parallel to the plane of the racquet head. In another embodiment of this invention, a depression is formed in the increased planner surface.

As seen in FIGS. 8 through 12, the handle has a first handle section 47 and a second handle section 48. The first handle section 47 is shown with the conventional octagonal design. The second handle section incorporates many of the novel features of this invention.

A protrusion 40 is located at the top of the handle and extends outwardly from an extension of top surface 20 and surface 28. The protrusion 40 is provided to receive the saddle of the hand between the thumb and the forefinger. This positively locates the longitudinal position of the hand with respect to handle length, and helps render full support to the racquet with the thumb in a comfortable angular position along expanded planner surface 18*a*. The protrusion 40 provides a convenient pivot about which the hand can rotate.

Figures 8, 9, 10:
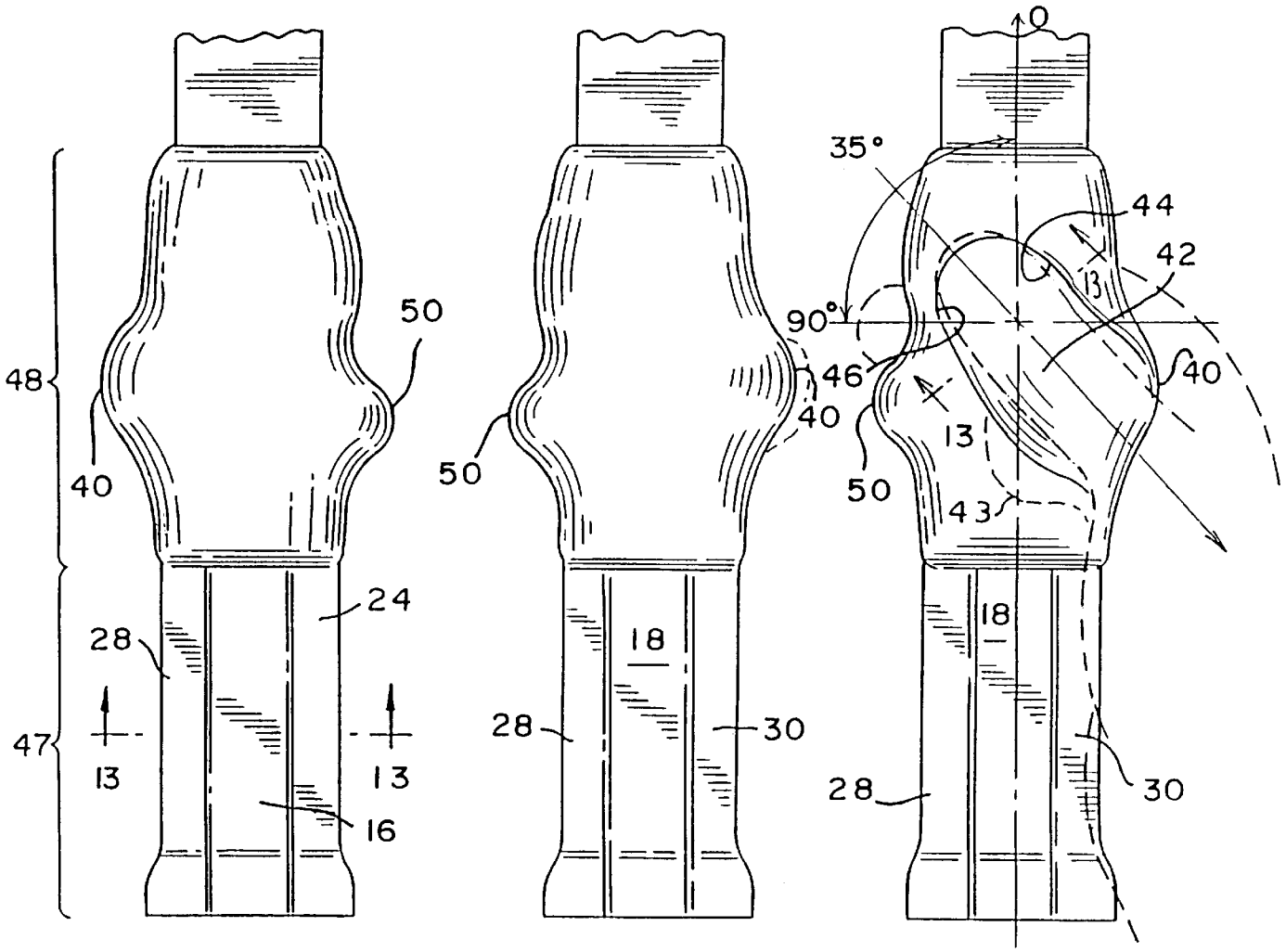
FIG. 8 is a plan view of the racquet handle according to this invention.
FIG. 9 is a bottom elevation view of the racquet handle shown in FIG. 8.
FIG. 10 is the same view as FIG. 9 with a thumb depression.
Figure 13:
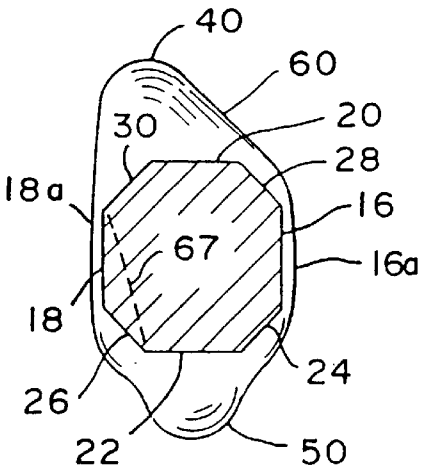
FIG. 13 is a cross-sectional view taken along the line 13—13 of FIG. 10.
Figure 12:
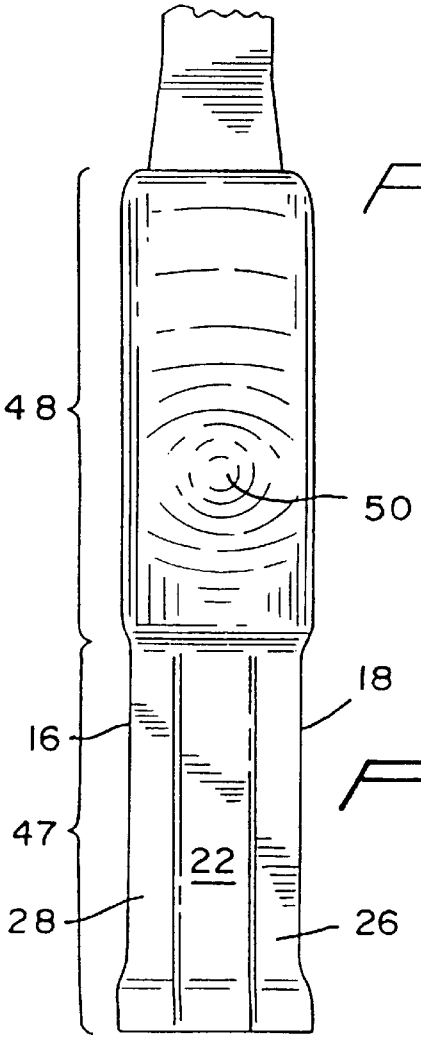
FIG. 12 is a side elevation of the opposite side of FIG. 11.
Figure 11:
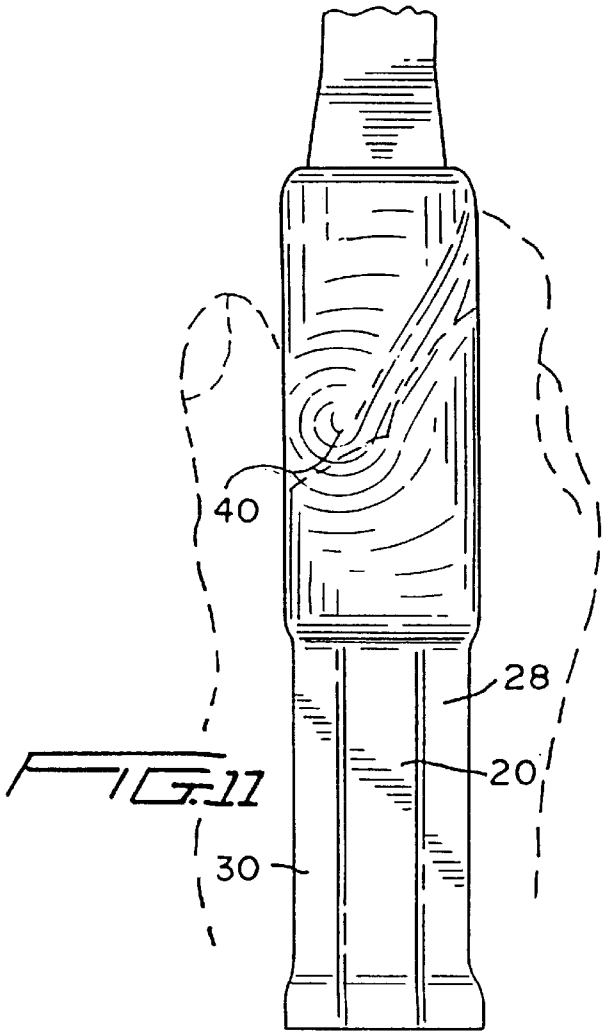
FIG. 11 is a top elevation of the racquet handle of FIGS. 9 or 10.
Figures 14, 15:
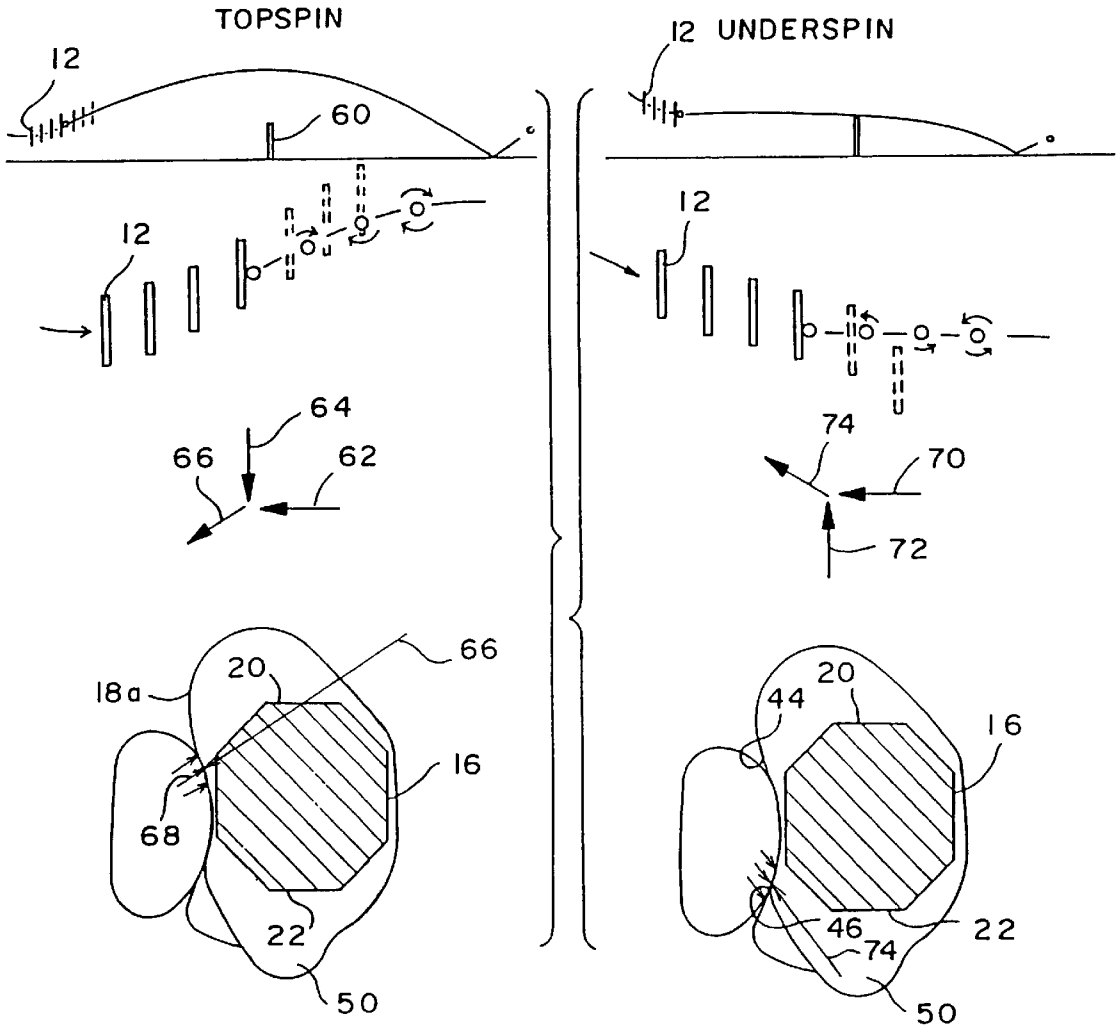
FIG. 14 is a series of diagrammatic depictions showing backhand topspin production.
FIG. 15 is a series of diagrammatic depictions showing backhand underspin production.

FIG. 10 is the same view as FIG. 9 with a diagonal depression 42 formed in the expanded left planner surface 18*a*. The depression 42, having sloping sidewalls 44 and 46 will provide surfaces for the thumb, in backhand strokes, to aid the player in creating an upward force (and absorbing the downward force of the ball against the racquet head) as the player strokes the ball from a low to a high position. For backhand backspin shots the depression will also provide a surface to create a downward force. This will aid the thumb in reacting to upward force. These functions will be better understood upon reading the descriptions of FIGS. 13 and 14 given hereinafter. Depression 42 can be enlarged as shown by the dotted line 43. Some players prefer the enlarged depression formed by 43.

The second handle section 28 is optionally equipped with what will be called a trigger or knob 50. The knob 50 is a protrusion that is located at the bottom of the handle section 28. The knob 50 extends outwardly from a plane extension of bottom surface 22 and when the player assumes an Eastern forehand grip, the knob is engaged by that segment of the index finger between the second and third knuckles. The trigger knob 50 together with protrusion 40 provides the user with a keen awareness of longitudinal position of the hand along the racquet handle and the disposition or attitude of the stringed racquet head 12 with respect to the player's hand. The knob 50 is also instrumental in causing the player to separate his fingers and locate them diagonally with respect to the handle axis for better racquet control.

These protrusions 40 and 50, taken together with the enlarged surface 18*a*, not only provide the user with a keen sense of racquet head location but will standardize his grip so that other stroke components can be more readily grooved.

FIG. 14 diagrammatically illustrates the travel of a ball hit with top spin. Top spin allows one to clear the net with a large safety factor and still cause the ball to land within the baseline. The second segment of FIG. 14 is a diagrammatic showing of the racquet head moving from low to high to impart ball rotation. As seen in FIG. 14, the ball is coming from the right as it strikes the racquet head 12. The player is moving his racquet head forwardly and from low to high. The force of the ball coming from the opposite court is diagrammatically indicated by the vector 62 and the force caused by the ball against the racquet as the racquet is moved from low and high to obtain top spin is indicated by the vector 64. The resulting force is inwardly and downwardly represented by the vector 66. As can be seen by the lowermost depiction of FIG. 13, the side wall 44 of the depression 42 permits the thumb to fully engage a surface opposite vector 66 (shown by the small arrows) and provide counter force that is represented by vector 68. This gives added strength and control to the player. Heretofore, insofar as the thumb is concerned, it has been friction between the thumb and the leather band that aided in counteracting this force. Here, when the depression 42 is used, the force is counteracted positively. The extension (or expansion) of the left planner surface 18*a* gives an additional frictional area and is advantageous. The depression gives a positive counter force.

FIG. 15 diagrammatically illustrates the same phenomena in reverse for a back spin. The force of the ball traveling from right to left as it approaches the racquet is indicated by the vector 70. The force represented by the high to low movement of the racquet in order to obtain the back spin is indicated by the vector 72. These two forces have a resulting force 74 which is met positively by the player when his thumb has the depression edge 46 with which to work.

Second handle section 48 also provides other configuration improvements. Note the rounded surface 51 which provides a surface more compatible with the hand of the user. Also note in FIG. 14 how protrusion 40 has an angular surface 60 to receive the saddle of the hand. The topography of protrusion 40 also provides a surface 60 to receive the base of the index finger.

Figure 17:
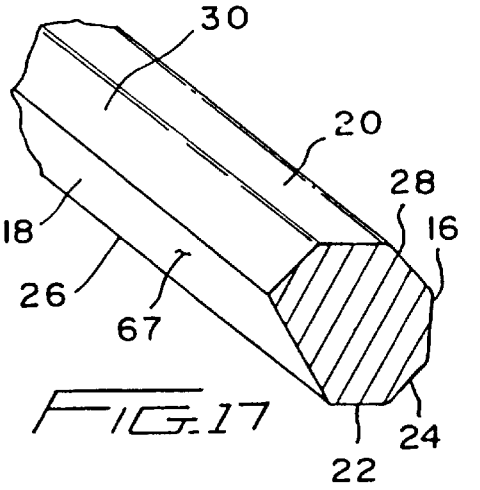
FIG. 17 is a perspective view of the FIG. 16 embodiment showing the thumb surface.
Figure 16:
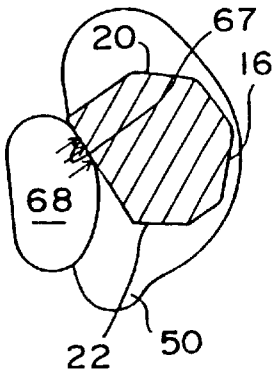
FIG. 16 is a cross-section view showing a modified octagonal that provides a thumb surface.

Another way to provide the thumb with a surface to counter the forces 62 and 64 is to eliminate the ridge between the trailing surface 18 and the lower left surface 26. This will provide a surface 67 upon which the thumb can rest. This provides full support during a top-spin backhand stroke. This feature can be utilized alone or with the trigger 50 and a protrusion 40. This embodiment is shown in FIGS. 16 and 17. Although sharp in the drawing, the end areas defining the surface 67 should be slanted and rounded for comfort.

It will be appreciated that the increase in size, shape and position of the enlarged handle and handle transition portions of the tennis racket handle can be varied. For a handle that is 7½ inches long, for example, the tennis racket handle of the following embodiment (FIGS. 18 and 19) is configured so that the base end of the handle transition portion is located about 3½ inches from the base of the handle shaft.

This is the distance at which the V-shaped area between the player's thumb and forefinger (the saddle) will comfortably come to rest on the protrusion 50 when the handle is gripped for a normal forehand stroke. To accommodate the V-shaped area of the player's hand, the handle transition portion can also extend about ¼–¾ inches to the base end. The enlarged handle portion will extend about 3¼–3¾ inches toward the throat end of the handle shaft to point "a". The total increase in handle width provided by the enlarged handle portion can range anywhere from about ¼–1½ inches.

Figure 19:
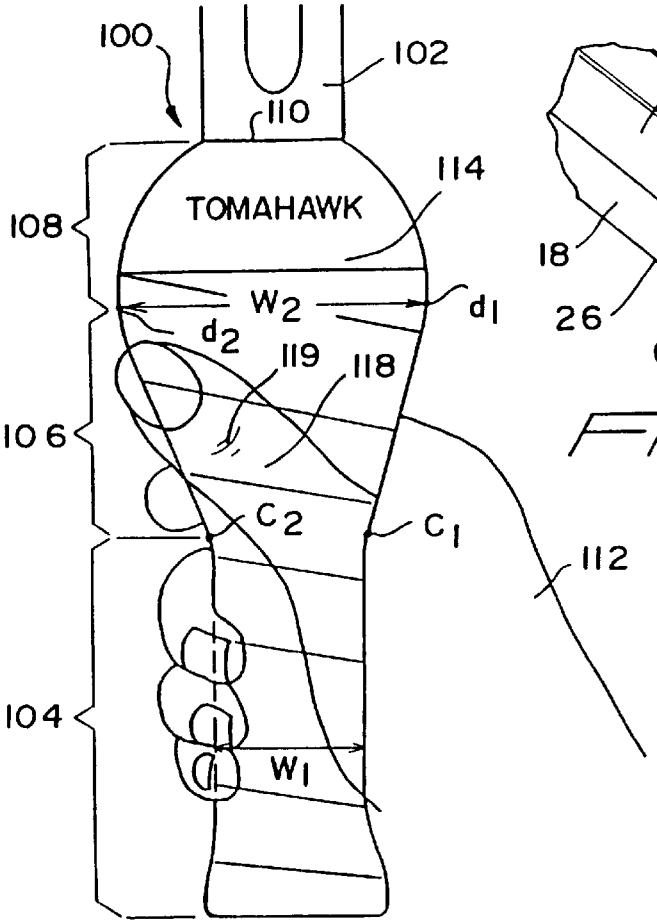
FIG. 19 is a plan view of a modified handle showing hand location for a backhand stroke.
Figure 18:
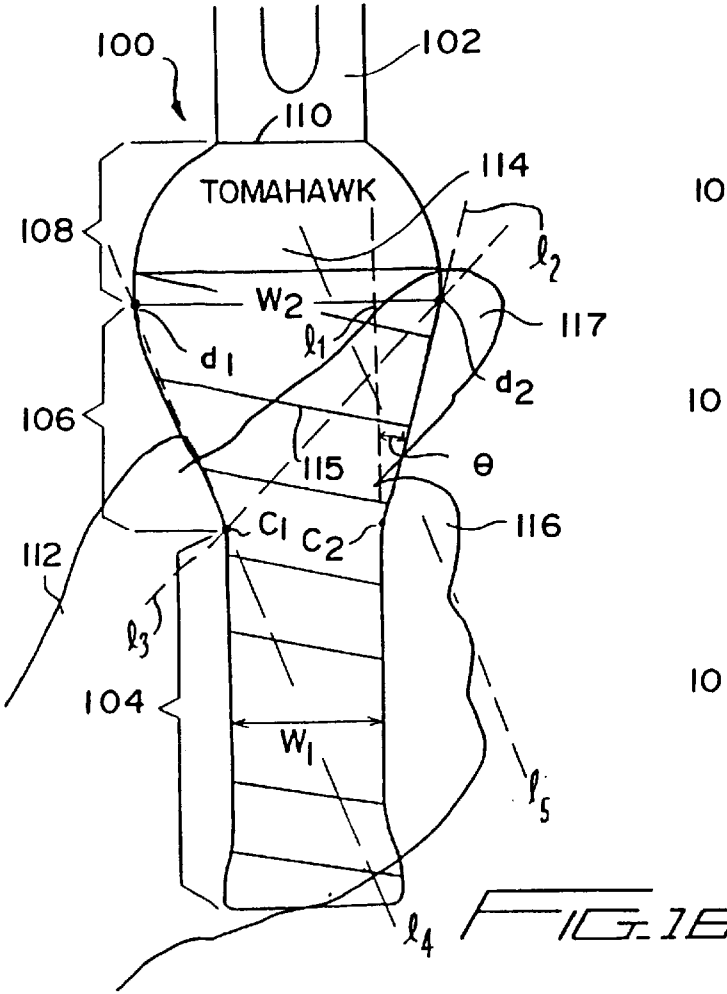
FIG. 18 is a plan view of a modified construction of a handle grip showing hand location for a forehand stroke.

In the embodiment of FIGS. 18 and 19, a tennis racket 100 includes a handle shaft 102 and a first handle portion 104 having a substantially uniform first width dimension w1 and a substantially uniform first depth dimension (not shown). The first handle portion extends to points "c1" and "c2" on each side of the handle. Extending from points "c1" and "c2" is a gently curved handle transition portion 106. The handle transition portion 106 in FIGS. 16 and 17 extends from the upper end of the first handle portion 104 at points "c1" and "c2" and extends to the area of the maximum width dimension w2, shown by the points "d1" and "d2". In the area of the points "c1" and "c2", the handle transition portion 106 has a concave curvature with respect to the player's hand 112. In the area of points "d1" and "d2", the handle transition portion 106 has a convex curvature with respect to the player's hand 112. An enlarged second handle portion 108 extends from points "d1" and "d2" and has a substantially uniform second depth dimension (not shown) which is substantially equal to the first depth dimension of the first handle portion 104, and a maximum width dimension w2 which is substantially larger than the first width dimension w1 of the first handle portion. Because points "d1" and "d2" are the points of maximum width w2, the enlarged handle portion 108 could be partially straight, or could gradually taper inwardly to the upper edge 110 thereof. In FIGS. 18 and 19, the enlarged handle portion 108 has a convex curvature relative to the player's hand 112 and tapers inwardly from the points "d1" and "d2" to an upper edge 110. Alternatively, the enlarged handle portion 108 is concave with respect to the player's hand to provide a "sword" effect.

Advantageously, the enlarged second handle portion 108, either alone or in combination with the handle transition portion 106, provides a wide, flat area 114, as shown in FIGS. 18 and 19, which can be used as an advertising area for displaying names, logos and other advertising indicia for manufacturers, sponsors and the like. For example, FIGS. 18 and 19 show the trademark "TOMAHAWK" appearing in the advertising area 114. As will be described, it is desirable, but not mandatory, in providing the advertising area 114, to maintain the depth dimension of the handle portion 108 relatively uniform to provide a substantially flat area extending across the width w2 for printing, the substantially flat area preferably being at least as wide as the width w1.

In the configuration of FIGS. 18 and 19, points "c1" and "c2" will typically be located about 3½ inches from the base of the handle shaft 102 so that the saddle shaped area of the player's hand 112 can be brought comfortably into engagement with the bottom of the handle transition portion 106 when the handle is gripped for a normal forehand stroke. The length of the handle transition portion 106 in the FIGS. 18 and 19 configuration preferably ranges from about 1–3½ inches, while the enlarged handle portion 108 can range from about ½–3 inches. The increase in handle width provided by the enlarged handle and handle transition portions (i.e. w2–w1) preferably ranges from about 1–1½ inches. The angle whose origin is at either of the points "c1" and "c2," and which measures the angle made by a line extending between the points "c1," "d1," or "c2," "d2," and a line "1" representing an extension of either of the sides of the first handle portion 104, preferably ranges between about 10–60 degrees and, is optimally about 17 degrees. In most cases, the handle transition portion 106 and the enlarged handle portion 108 will be sized so that the player's index finger 115 can be angled upwardly and away from the remaining fingers 116 on a line generally extending from the points "c1" or "c2" on one side of the handle shaft 102, to the points "d2" or "d1," respectively, on the other side of the handle shaft. During forehand strokes, the edge parallel to a line extending generally through the knuckles of the player's hand 112. This orients the hand in the manner shown in FIG. 18 during forehand strokes, and allows the forefinger 117 to naturally extend from the points "c1" or "c2" on one side of the handle to the points "d2" or "d1", respectively, on the other side of the handle. Because points "d1" and "d2" represent a widened grip area providing purchase points for the thumb and forefinger, the player's fingers tend to spread apart in a manner which has been determined to provide increased degrees of controlled power during both forehand and backhand strokes.

In the embodiment of FIGS. 18 and 19, broad surfaces are provided to the hand for backhand and forehand strokes. Particular reference is made to the surface that permits the thumb to be fully supported along its length. In the embodiment of FIG. 10, for instance, the corresponding surface is formed with a depression for good thumb support.

As has been discussed above, racquet handles have remained virtually unchanged for many years. There has been described a new racquet handle configuration which provides accurate positioning of the hand for every stroke, be it forehand or backhand. This permits the player to better grip the racquet and groove his strokes while, at the same time, his hand configuration is better able to give a more definitive signal to the brain for purposes of racquet head awareness.

I claim:

1. A handle configuration for a racquet that supports a stringed racquet head at its outer end and is terminated at a base end, comprising:

an annular ridge about said base end;

a first handle section extending from said ridge a distance sufficient to accommodate the middle, fourth and little fingers of a user and having a substantially uniform width dimension defined by a first surface and a second surface and a substantially uniform depth dimension defined by a top surface and a bottom surface;

a second handle section axially extending from said first handle section, including said top surface and said bottom surface thereof, toward said racquet head, said second handle section having;

a first protrusion extending outwardly and axially away from said top surface of said first handle section and located so as to engage the connecting saddle between the thumb and index finger of the user when the butt of the user's hand is in engagement with said ridge;

a trigger protrusion extending outwardly and axially away from said bottom surface of said first handle section and adapted for location between the index finger and the middle finger of the user when the butt of the hand rests against said ridge.

2. The handle configuration of claim 1 wherein said first surface of said second handle section has a depth greater than said depth of said first handle section and wherein the rear surface during a backhand stroke thereof is sufficient in area to fully support the thumb of the user when the thumb is placed diagonally across said surface.

3. The handle configuration of claim 2 wherein a depression is formed in said first surface to receive the thumb of the user when the user places the first knuckle of the forefinger against said top surface.

4. The handle configuration of claim 3 wherein a depression is formed in said second surface to receive the thumb of the user during a backhand grip.

5. A tennis racquet comprising:

a racquet head lying in a first plane and having a front surface and a rear surface;

an elongated handle extending outwardly from said racquet head to a terminal end and having its center axis lying in said first plane;

said handle having a substantially uniform first handle section defined by front and rear surfaces and, top and bottom surfaces perpendicular to said front and rear surfaces;

an annular abutment ridge adjacent said terminal end against which the butt of the hand may rest when the racquet is in use;

a knob protruding outwardly from said bottom surface so as to be located between the middle finger and the index finger of a user when the butt of user's hand is in engagement with said ridge.

6. The racquet of claim 5 wherein said front surface, which is the trailing surface during a backhand stroke, is formed with a depression for receiving the thumb of the user when said user places the first knuckle of the gripping hand over said top surface.

7. The racquet of claim 6 wherein upper and lower side walls defined said depression and said sidewalls are of sufficient depth to aid the thumb during upward and downward movement of the racquet when the racquet strikes a ball.

* * * * *